US006443233B1

(12) United States Patent
Aebischer

(10) Patent No.: US 6,443,233 B1
(45) Date of Patent: Sep. 3, 2002

(54) APPLIANCE FOR INTRODUCING AN INERT GAS INTO AN EXTINGUISHANT

(75) Inventor: Frédéric Aebischer, Luterbach (CH)

(73) Assignee: Alstom, Paris (FR)

( * ) Notice: Subject to any disclaimer, the term of this patent is extended or adjusted under 35 U.S.C. 154(b) by 55 days.

(21) Appl. No.: 09/643,681

(22) Filed: Aug. 24, 2000

(30) Foreign Application Priority Data

Aug. 24, 1999 (EP) ..... 99 810 756.9

(51) Int. Cl.[7] ..... A62C 35/00

(52) U.S. Cl. ..... 169/14; 169/11; 169/15; 169/44; 169/9; 239/416.5; 239/423; 239/547

(58) Field of Search ..... 169/14, 11, 15, 169/44, 45, 53, 68, 6, 9; 239/410, 416.4, 416.5, 423, 542, 547, 562, 289, 142

(56) References Cited

U.S. PATENT DOCUMENTS 719,946 A * 2/1903 Loffler
1,294,776 A * 2/1919 Culmer ..... 169/44
4,064,944 A * 12/1977 McClure et al. ..... 169/9
4,270,612 A * 6/1981 Larsson ..... 169/45
4,643,260 A * 2/1987 Miller ..... 169/46
6,003,608 A * 12/1999 Cunningham ..... 169/46
6,173,790 B1 1/2001 Russwurm et al.

FOREIGN PATENT DOCUMENTS

EP 0 798 019 10/1997

* cited by examiner

*Primary Examiner*—Lesley D. Morris
*Assistant Examiner*—Dinh Q. Nguyen
(74) *Attorney, Agent, or Firm*—Burns, Doane, Swecker & Mathis, L.L.P.

(57) ABSTRACT

An apparatus for introducing liquid and/or inert gas into a liquid extinguishing medium, including an extinguishing line having at least one extinguishing nozzle; an extinguishant supply line, having a non-return valve, which provides extinguishant to the extinguishing line; a supply tube, having a metering valve, which provides liquid and/or inert gas to the extinguishing line; and a perforated distributor body, within the extinguishing line, having at least one hole arranged along the distributor body and between two sequentially extinguishing nozzles.

8 Claims, 2 Drawing Sheets

APPLIANCE FOR INTRODUCING AN INERT GAS INTO AN EXTINGUISHANT

FIELD OF THE INVENTION

The invention relates to an appliance for introducing liquid and/or gaseous inert gas into a liquid extinguishing medium, essentially consisting of an extinguishing line provided with extinguishing nozzles, into which extinguishing line an extinguishant supply line provided with a non-return valve opens, and into which extinguishing line a supply tube opens for the liquid and/or gaseous inert gas, which supply tube is provided with a metering valve.

BACKGROUND OF THE INVENTION

The introduction of liquid and/or gaseous inert gas into a liquid extinguishing medium is sufficiently known:

An appliance is described in WO-95/24274 in which the gaseous inert gas additionally acts as the driving agent for the extinguishant. The inert gas is introduced to the mixing appliance intermittently and, in fact, in a quite definite quantity in order to achieve a defined plug flow with separated gas and water parts in the feed line to the extinguishing nozzle. The flow emerging from the extinguishing nozzle is subjected to an acoustic field whose frequency is a multiple of the frequency of the plug flow within the feed line.

A further known solution for manual fire extinguishers in accordance with DE-U1 295 10 982 provides for $CO_2$ to be supplied to the extinguishant at the extinguishing nozzle itself. This is intended to generate a homogeneous aerosol-type water mist jet with water droplets brought down to freezing temperature.

Also known from WO-95/28204 or WO-95/28205 are mixing appliances in which the gaseous inert gas is likewise used as the driving agent for the extinguishant. The object of these appliances is an effective mixing without delay of the gas with the extinguishing fluid. This mixture then flows via a line to the extinguishing nozzles which are arranged downstream in series. Tests have shown that, in such an arrangement, the pressure in the system immediately collapses as soon as the gas-containing extinguishant acts on the first extinguishing nozzle. The result of this is that the extinguishing nozzles located downstream are no longer adequately supplied with extinguishant.

EP-A-0 798 019 describes a method and an appliance in which a liquid inert gas is supplied under increased pressure to the extinguishant in order to generate a two-phase bubble flow. For this purpose, more inert gas is supplied than can go into solution under the given pressure relationships and the residence time selected. An aerosol with optimum droplet size for combating fire appears at the extinguishing nozzle.

Tests have shown that, in the appliance in accordance with EP-A-0 798 019, the surplus inert gas reseparates after a certain time from the extinguishant in the pipework. Help is provided in this case by a subsequent mixing appliance, such as is known from EP-A-0 904 806 and in which an extinguishant which is oversaturated with inert gas is again generated. The injection means, which can be radial holes, in the case of the mixing appliance in accordance with EP-A-0 904 806 are dimensioned in such a way that a homogeneous fine distribution of the gas with the smallest possible gas bubbles has been achieved in the water on injection of the inert gas into the duct through which the extinguishant is flowing. In this arrangement, however, it is necessary to ensure that the nozzle holes are, in turn, large enough to reliably avoid freezing of the openings. In order to form a defined bubble flow downstream of the injection, more $CO_2$ is introduced into the extinguishant than can go into solution. The excess proportion which is not dissolved is present in the form of bubbles. Depending on the respective pressure and temperature, the mixture has a tendency to evaporate; a pressure loss in the line will therefore cause evaporation. Compensation is provided for part of the pressure drop by degassing the dissolved inert gas. The evaporation causes an increase in volume. This measure at least achieves advantageous retention of pressure, as has been found by tests. In the end, this means that all the extinguishing nozzles are subjected to approximately the same extinguishing pressure, independently of the associated line length. In the case of excessively large holes in the injection means, however, the desired homogeneous fine distribution of the gas, as already mentioned at the beginning, cannot be achieved in the water. In order to provide help on this point, means which influence the flow—in the form of vortex generators—are arranged in the duct through which flow occurs. These vortex generators are arranged in such a way that a sufficiently large mixing zone is available downstream of them within the casing. These means which influence the flow can also be provided again further downstream if the inert gas surplus begins to separate from the extinguishant.

SUMMARY OF THE INVENTION

The invention is based on the object of creating an appliance, of the type mentioned at the beginning, in which all the extinguishing nozzles are supplied with extinguishant of sufficient pressure, while avoiding auxiliary means which influence the flow.

In accordance with the invention, this is achieved by the supply tube merging into a perforated distributor body within the extinguishing line, which distributor body extends along the extinguishing line, and in which arrangement at least one hole is arranged in the distributor body between each two sequential extinguishing nozzles in the flow direction of the extinguishing medium in the extinguishing line.

The advantages of the invention may be seen, inter alia, in the particular simplicity of the measure. The appliance is very effective at a given low water pressure. The extinguishing system upstream of the non-return valve can be designed for the 16 bar which is suitable for fire protection, whereas the system downstream of the non-return valve has to be dimensioned to average pressures in the region of approximately 40 bar. The increased pressure level relative to conventional low-pressure systems has, in consequence, an increased extinguishing performance—inter alia because of the attainable finer atomization with a simultaneously increased projection distance. The quantity of extinguishant can be massively reduced due to the cyclic operation possibility provided. Because the pressure is not introduced into the system upstream, but in the immediate vicinity of the extinguishing nozzles, the system reacts with extraordinary rapidity. Multiple connection locations are dispensed with because the distributor body is now arranged within the extinguishing line.

It is particularly advantageous for the distributor body to be a flexible hose. Such a distributor body can be adapted without difficulty to any possible geometry of the extinguishing line.

An obvious possibility is to employ a high-pressure plastic hose as the flexible distributor body. Such a commercial product, for pressures up to 90 bar for example, is easily processed. The use of plastic, furthermore, eases the problem of icing when the liquid inert gas enters the extinguishant and, by this means, simplifies the choice of the size and number of the holes in the distributor body.

It is expedient for the center lines of the extinguishing nozzles in the extinguishing line to be directed at least approximately parallel to the potential fire surface. A so-called spatial protection can be effected by this means. In the previously usual, essentially vertical, spraying of the fire surface, it is generally necessary to spray against the thermal current of the flame. Because of this, it is difficult for the extinguishant to reach the actual source of the fire. The new parallel spray system—in the case where a machine has to be protected, this is understood to mean that the center line of the spray cone extends essentially coaxially with the center line of the machine—is based less on the previously known cooling principle but, rather, on the suffocation principle. The idea is to simply blow the flame away by means of the extremely fine extinguishant mist. In this arrangement, the extinguishant is sprayed into the zone between the combustible and the flame.

BRIEF DESCRIPTION OF THE DRAWINGS (A) Preferred embodiment/s of the invention is/are disclosed in the following description and illustrated in the accompanying drawings, in which:

Not shown is the preparation of the inert gas and the extinguishant, which is undertaken upstream of the extinguishing appliance.

DETAILED DESCRIPTION OF THE INVENTION

Figure 1:
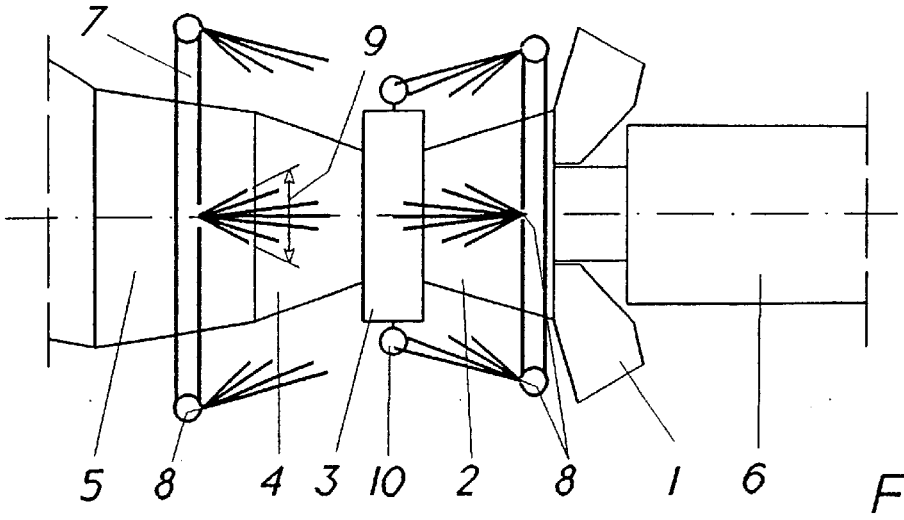
FIG. 1 shows a longitudinal view of an installation equipped with two extinguishing lines.

In FIG. 1, a gas turbine block is diagrammatically represented with the elements generator 6, air inlet 1, compressor 2, combustion chamber 3, gas turbine 4 and outlet diffuser 5. Such a gas turbine block is to be provided with fire extinguishing means in the region of its two ends. These means consist essentially of an extinguishing line 7 with extinguishing nozzles 8 emerging from it. The extinguishing nozzles of the two extinguishing lines 7, which are at an axial distance from one another, are directed so that they are mutually opposed. They are arranged and dimensioned in such a way that extinguishant can sweep the whole of the surface of the machine and act on the surrounding space. In this arrangement, the extinguishant is guided substantially parallel to the machine center line or parallel to the endangered surface.

Figure 2:
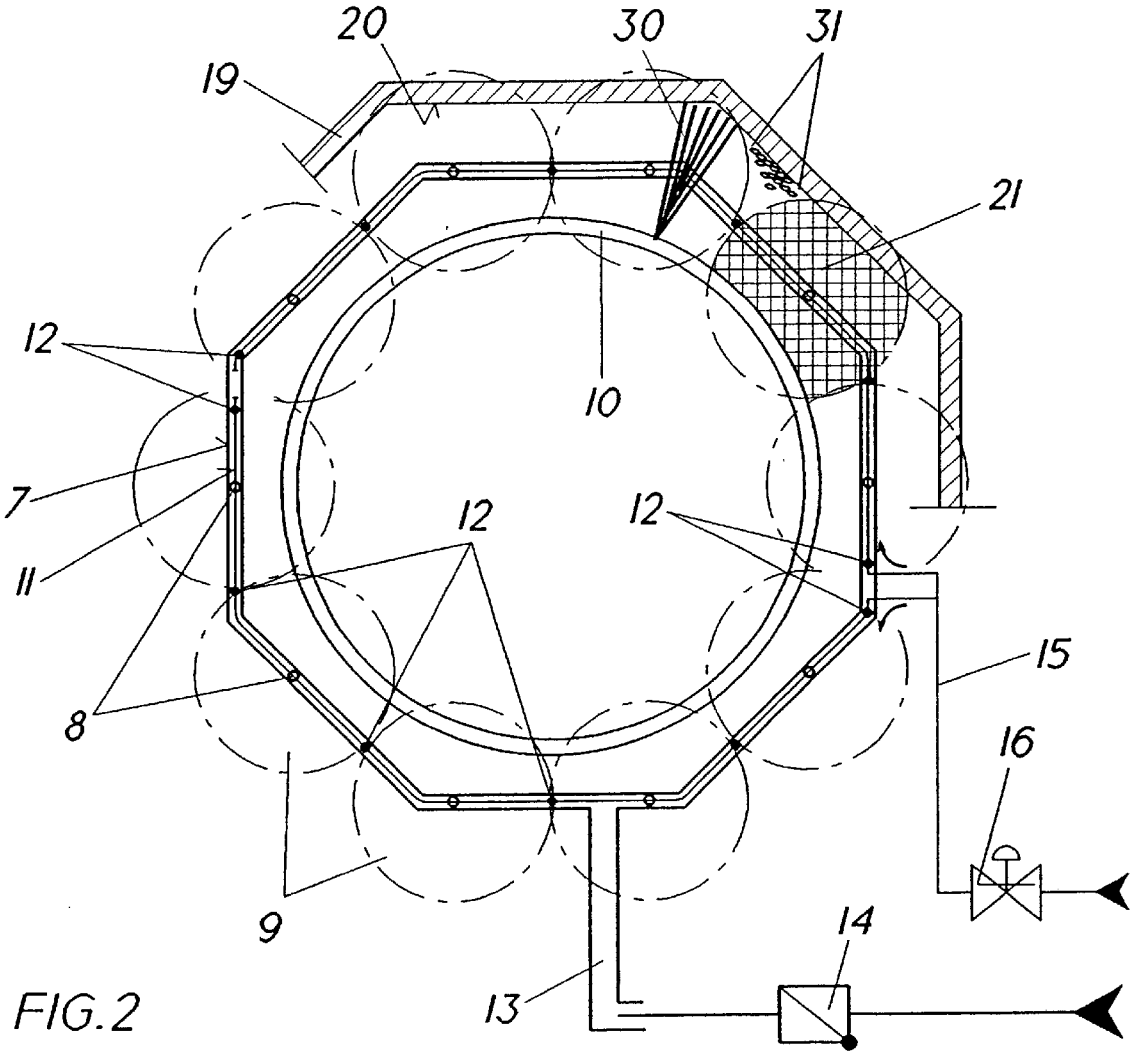
FIG. 2 shows a front view of the installation with extinguishing appliance.

The arrangement of the extinguishing nozzles is shown in FIG. 2. Assuming that the extinguishing nozzles used have an effective spraying cone 9 of approximately 1.7 m diameter, a ring-shaped arrangement of ten extinguishing nozzles evenly distributed around the periphery is derived which takes account of the defining diameter of the machine to be protected. As an example, the ring-shaped fuel supply line 10, which is laid around the machine and feeds the burners of the combustion chamber 3, can in this case be considered as one of the determining machine diameters. In the example shown, the ten extinguishing nozzles are arranged in a frame-type extinguishing line 7, which in this case has eight (8) equal sides. It is obvious that the geometry of the actual extinguishing line is of no importance. For simplicity, it can be ringshaped and preferably consist of circular tubing. The important feature for the mode of operation of the invention is the acceptance capacity of the line.

With respect to this acceptance capacity, it is assumed that water is provided as the extinguishant. It is also assumed that a fire can be extinguished in one extinguishing cycle. Finally, a spray-water quantity of approximately four liters of water per nozzle is assumed for the extinguishing procedure. If the extinguishing line extends as a circular ring and if the ring diameter is known from the machine specifications, the cross section of the extinguishing line necessary to accept the extinguishant can be calculated.

The extinguishing line 7 is filled with water at a pressure of between 4 and 10 bar, preferably 6 bar, and a temperature of preferably 10° C. by means of an extinguishant supply line 13. A non-return valve 14 is arranged in this extinguishant supply line. During the filling procedure, the air (or residual gases from a previous extinguishing cycle) present in the extinguishing line is sprayed out of the system via the extinguishing nozzles 8. The filling procedure is considered to have been concluded if all the gases have been removed and the ring line contains only water. The water subsequently flows out of the nozzles in the low pressure range without appreciable effect. The proportion sprayed out is continuously made up via the non-return valve. The filled extinguishing line 7 can be considered as a quasi-closed system. This is understood to mean that all the measures downstream of the non-return valve are, fundamentally, undertaken in stationary and not in flowing extinguishant. It is obvious that, depending on the geometry and the size of the line 7 and the number and distribution of the extinguishing nozzles, the extinguishing line can also have a plurality of evenly distributed filling connections. This is particularly so where a rapid filling procedure is desired.

Up to this point, extinguishing systems are known. In order to increase the pressure in the extinguishing line to an effective amount, an inert gas is added under pressure to the system, as described at the beginning. As a rule, this takes place either at a central position far upstream of the extinguishing nozzles or directly within the extinguishing nozzles. Both solutions have such grave disadvantages that they cannot be considered for many applications.

The invention is applied at this point. It provides for introducing the necessary pressure into the system filled with extinguishant, water in the present case, in the immediate vicinity of the extinguishing nozzles. For this purpose, the liquid or gaseous inert gas, $CO_2$ in the present case, is first introduced into the extinguishing line 7 by means of a supply tube 15—as in the solutions included in the prior art. A metering valve 16 is arranged in this supply tube, which is fed by means of a $CO_2$ connection (not shown). Other water-soluble agents and/or $N_2$ or air are, of course, conceivable instead of $CO_2$. The liquid $CO_2$ is fed into the connection via a high-pressure line (likewise not shown) at a maximum pressure of 55 bar and a temperature of approximately 15° C. In this arrangement, the $CO_2$ expands to the extinguishant pressure of approximately 6 to 10 bar and, in the process, increases the pressure of the content of the extinguishing line to approximately 30 bar. During this inflow process, the liquid $CO_2$, exhibiting a maximum of −30° C., is heated to the extinguishant temperature. The metering valve 16 is used for the actual quantity control and also for possible intermittent operation.

The introduction of the necessary pressure in the immediate vicinity of the extinguishing nozzles now takes place in the simplest manner. An inert gas distributor body 11 provided with holes 12 is laid within the extinguishing line—which, as already mentioned, can be of any given geometry and size. In the example, it is a commercial, flexible high-pressure plastic hose which extends along the extinguishing line. The transition from the supply tube 15 to the perforated distributor body 11 takes place at two locations in the extinguishing line 7, as shown in FIG. 2. The reason for this is, on the one hand, that it is desired to avoid a fairly large pressure drop in the case of a fairly large number of extinguishing nozzles 8 in series arrangement with corresponding length of the distributor body. On the other hand, subjecting two (or a plurality of) parallel branches of the hose with inert gas permits a more rapid initiation of the extinguishing cycle. In the arrangement shown with two parallel legs, it is obvious that the distributor body cannot form a closed system. In consequence, the hose ends are closed at their end opposite to the inlet.

The present idea is that at least one hole 12 is arranged in the distributor body 11 between each two extinguishing nozzles 8 following one another in the flow direction of the extinguishing medium in the extinguishing line 7. The flow direction is here understood to mean the flow direction 40 of the extinguishing medium during the filling procedure. During an extinguishing cycle, this should cause half the admission from the quasi-closed system to an extinguishing nozzle to be from downstream water and half to be from upstream water. With a filled extinguishing line in this arrangement, the objective is an extinguishing cycle of only some 3 to 4 seconds, i.e. all the water should be sprayed out within this period.

The mode of operation of the invention is explained below using two embodiment variants. In both cases, the diameter of the circular extinguishing line is approximately 50 to 70 mm and that of the hose is approximately 10 mm.

Figure 3:
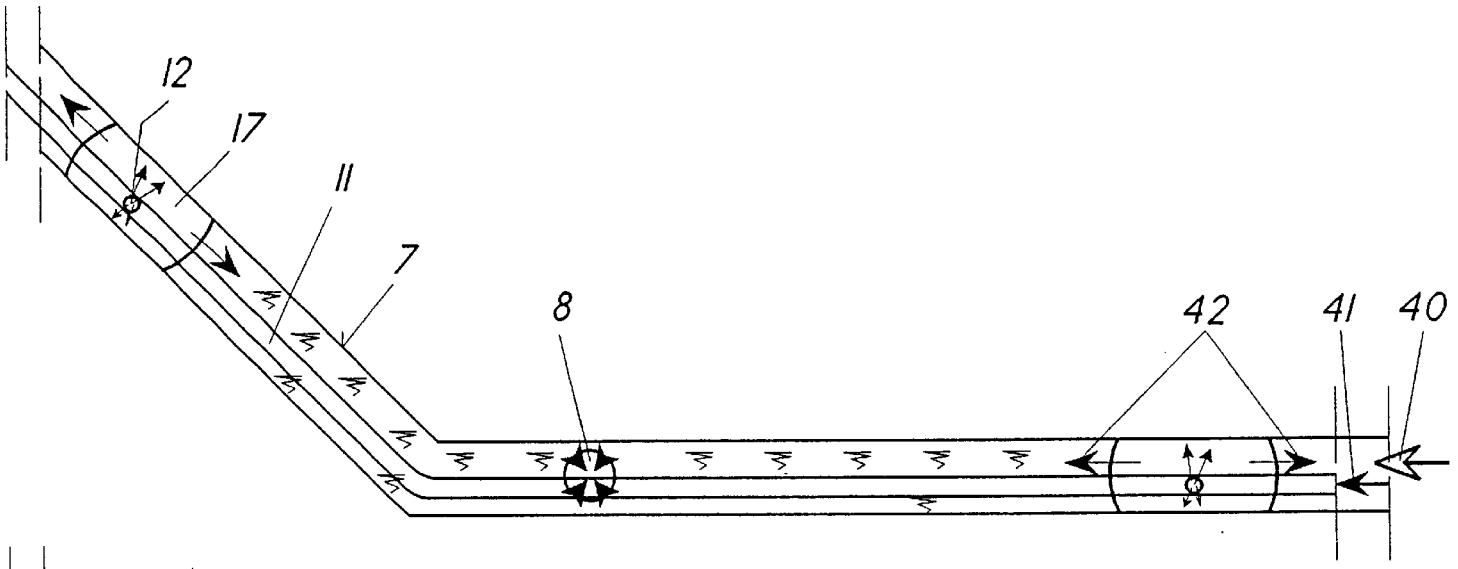
FIG. 3 shows a detail of the extinguishant subjected to pressure.

In the first example, which is illustrated in FIG. 3, only one hole 12 is actually arranged in the hose 11 between each two extinguishing nozzles 8. It is obvious that the arrangement can also involve a group of holes which could be evenly distributed in the same plane over the periphery of the hose. In the example, the diameter of the hole, which is only applied to one side, is approximately 3 mm. Tests have shown that it is not at all necessary for this hose 11 to extend coaxially within the extinguishing line. If the hose is acted on by inert gas which emerges from the holes 12 in the extinguishing line, it centers itself. At this point, it should also be mentioned that the quoted hole diameter of 3 mm only applies to a certain pressure. If the pressure drops in the case of numerous holes arranged in series because of the unavoidable loss of pressure in a fairly long distributor body, the diameter of the holes 12 must be increased further downstream in order to introduce the same gas volume into the extinguishant.

When an extinguishing cycle is initiated, the following occurs: The extinguishing line 7 was filled with water in the direction of the arrow 40. Liquid inert gas is now fed into the distributor body in the direction of the arrow 41 via the supply tube 15. Extinguishant which may have penetrated into the distributor body via the holes 12 is displaced by the inert gas. The inert gas passes via these same holes 12 into the extinguishing line, where it produces a gas cushion 17 and an immediate increase in pressure in the extinguishant. In addition, depending on the pressure and temperature, a substantial amount of the inert gas injected goes into solution in the extinguishant. As has been shown by tests, the extinguishant whose pressure has been increased necks in the spray cone appropriately when emerging from the extinguishing nozzles, which permits the conclusion that there is a large energy content. The projection distance of the spray mist is correspondingly large. As a rule, the pressure in the extinguishing line is maintained by supplying inert gas until all the water has been sprayed out. In this case, the gas cushion 17 expands to both sides in the direction of the arrow 42. If, after pushing the water column out completely, the gas bubble 17 reaches the extinguishing nozzle 8, the pressure within the extinguishing line 7 collapses. If the supply of inert gas has not been shut off already, it is now closed off by means of the metering valve 16. The collapse of the pressure within the extinguishing line has the result that the non-return valve 14 is opened by the pressure on the inlet flow side. Because of this, the extinguishing line 7 is refilled with extinguishant and is ready for a new extinguishing cycle. A flame alarm will generally decide on the further course of action. Further cycles can also, of course, be run in the case where fire no longer exists. This could be found particularly sensible if the object is to cool hot surfaces with the smallest possible quantities of water. It has been found that the arrangement described with only one hole 12 between two sequential extinguishing nozzles 8 is effective in the case of both vertically and horizontally extending extinguishing lines 7.

Figure 4:
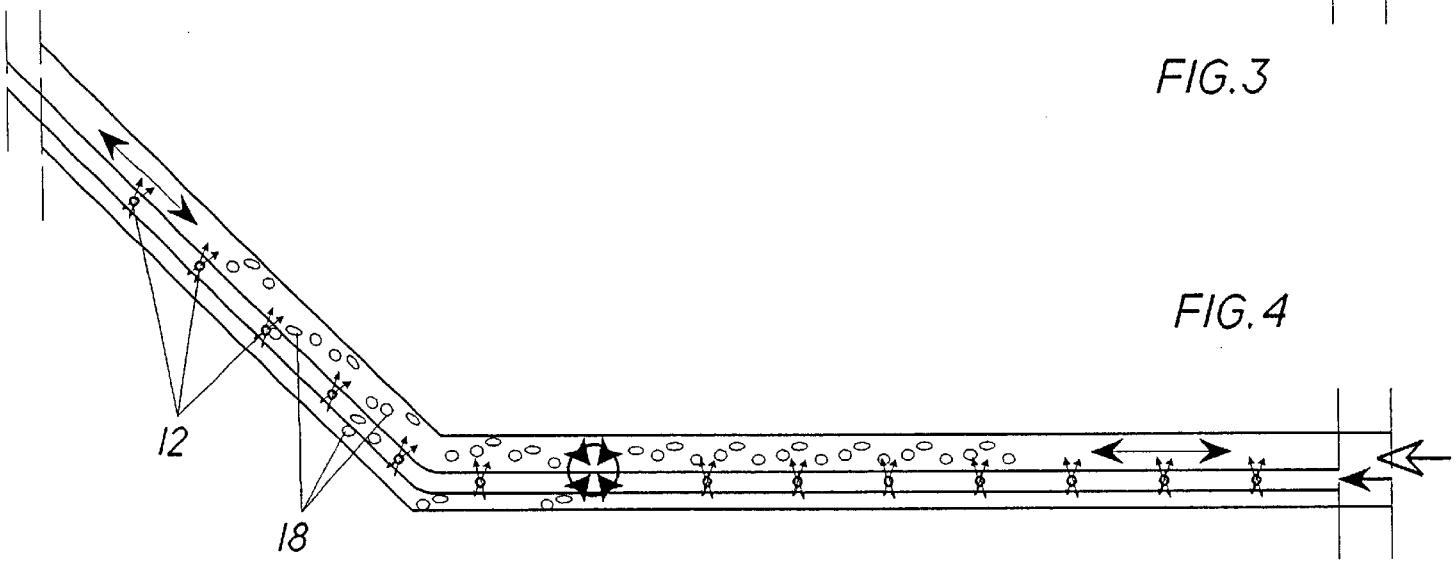
FIG. 4 shows an embodiment variant of the hole arrangement of FIG. 3.

In the second example, which is illustrated in FIG. 4, a plurality of holes or drillings 12 are provided as injection means in the hose 11 between each two extinguishing nozzles 8. These radial drillings in the hose 12 are dimensioned in such a way that a homogeneous fine distribution of the gas with the smallest possible gas bubbles in the water has already taken place on injection of the inert gas into the internal space, filled with extinguishant, of the extinguishing line 7. In this case, however, attention must be paid to ensuring that the nozzle drillings 12 are large enough to reliably avoid freezing of the openings. On contact with the warmer water, the liquid inert gas is converted into the gaseous condition and, in the process, goes into solution. The first objective is then to dissolve as much gas as possible; the object is to achieve the saturation condition of the mixture. For the purpose of forming a defined bubble flow downstream of the injection, more $CO_2$ is introduced into the extinguishant than can go into solution. The undissolved excess proportion is present in the form of bubbles 18. The resulting increase in pressure within the extinguishing line and the outflow mechanism from the extinguishing nozzles are the same as in the example, mentioned above, with only one hole between two extinguishing nozzles.

As already mentioned, the extinguishing nozzles 8 are arranged and dimensioned in such a way that the whole of the machine surface can be swept with extinguishant and the surrounding space acted upon uniformly. The extinguishant is essentially guided parallel to the machine center line or to the endangered surface. This "axial" spraying therefore effects actual spatial protection. This spatial protection can, under certain circumstances, be extremely desirable, particularly in the case of machines which are surrounded by a noise-absorbing enclosure. Such an enclosure 19 surrounding the essential parts of the gas turbine is partially represented in FIG. 2. These noise-protection elements are sheetmetal cassettes which are filled with mineral wool. The inner wall is formed by a perforated sheet through which the noise waves can penetrate into the noise-absorbing mass. The space 21 (shown crosshatched) acted upon by a spray cone 9 is bounded, on the one hand, by the potential fire surface of the burning object, the fuel supply line 10 in the example and, on the other hand, by the inner wall 20 of the gas turbine encasement, in this case the enclosure 19.

As is indicated symbolically by 30 in FIG. 2, the case could well occur where burning oil is sprayed from the fuel supply line 10 toward the enclosure 19 and runs down along the inner wall 20. It is not difficult to see that the space 21 itself is not protected in the case of the previous solutions, in which the extinguishing nozzles were generally arranged in the region of the outer enclosure and were directed almost vertically onto the machine—radially in the present case. This applies particularly to the immediate region of the enclosure wall. The new type of nozzle direction, on the other hand, extinguishes both the fire source itself and the flames on the burning enclosure. This takes place by blowing away the flame by means of the powerful fine extinguishant mist and by subsequent suffocation. It is possible that burning oil running down the wall 20 is not extinguished by the extinguishant of a first spray cone allocated to the corresponding wall section. In this case, the burning oil will reach the zone of action of the lower, adjacent spray cone while it is running down and will be extinguished there.

This procedure can possibly take place in the same extinguishing cycle. As already mentioned, the intention is, namely, to extinguish fire which may occur within only one cycle with a duration of approximately 3 to 4 seconds. It can, of course, happen that the fire is not completely extinguished in the short interval of 3 to 4 seconds, particularly in the case described of a jet fire with burning of the surrounding enclosure. Thus oil which is still burning can be located on the inner wall 20 in the region 31 between two spray cones even if the fire source itself has already been extinguished. The fire has the property of itself sucking in the fine water mist generated by strong turbulence.

In this case, a further extinguishing cycle would be necessary. In order to cover such a case, it is expedient to arrange flame alarms for monitoring purposes within the enclosure 19. These can be of the infrared type known per se, i.e. they are capable of recognizing a fire through a smoke and/or water mist. It is also conceivable to undertake automatic control of extinguishing cycles by infrared flame alarms.

The invention is not, of course, limited to the embodiment examples shown and described. As a departure from pure water as the extinguishant, a water/foam mixture would also be conceivable. In addition to $CO_2$, nitrogen or air can also be used as the inert gas. Larger variations with respect to the values given for extinguishant and inert gas are also possible. Fundamentally, more $CO_2$ can be dissolved as the water pressure is increased and the water temperature is lowered, which has an advantageous effect on the performance capability of the spray cone.

What is claimed is:

1. An apparatus for introducing liquid and/or inert gas into an extinguishant, comprising:

an extinguishing line including at least one extinguishing nozzle;

an extinguishant supply line, having a non-return valve, which provides the extinguishant to the extinguishing line;

a supply tube, having a metering valve, which provides liquid and/or inert gas to the extinguishing line; and a perforated distributor body, within the extinguishing line, having at least one hole arranged along the distributor body and between two sequentially extinguishing nozzles in the flow direction of the extinguishant in the extinguishing line, wherein the at least one hole in the distributor body is dimensioned in such a way that a gas cushion, which appears in the region of the hole and acts on the extinguishant, is formed in the extinguishing line between two adjacent extinguishing nozzles during an extinguishing cycle.

2. The appliance as claimed in claim 1, wherein the distributor body is a flexible hose.

3. The appliance as claimed in claim 2, wherein the flexible hose is a high-pressure hose.

4. The appliance as claimed in claim 1, wherein the center lines of the extinguishing line are directed at least approximately parallel to the potential fire surface.

5. An apparatus for introducing liquid and/or inert gas into an extinguishant, comprising:

an extinguishing line including at least one extinguishing nozzle;

an extinguishant supply line, having a non-return valve, which provides the extinguishant to the extinguishing line;

a supply tube, having a metering valve, which provides liquid and/or inert gas to the extinguishing line; and a perforated distributor body, within the extinguishing line, having at least one hole arranged along the distributor body and between two sequentially extinguishing nozzles in the flow direction of the extinguishant in the extinguishing line, wherein a plurality of holes are provided in the distributor body between each two extinguishing nozzles, the holes being arranged and dimensioned in a way that a two-phase mixture with bubble flow is formed in the extinguishant during an extinguishing cycle.

6. The appliance as claimed in claim 5, wherein the distributor body is a flexible hose.

7. The appliance as claimed in claim 6, wherein the flexible house is a high-pressure plastic hose.

8. The appliance as claimed in claim 5, wherein the center lines of the extinguishing line are directed at least approximately parallel to the potential fire surface.

* * * * *